US011897584B1

(12) United States Patent
Figura et al.

(10) Patent No.: US 11,897,584 B1
(45) Date of Patent: Feb. 13, 2024

(54) BOAT CLEAT FOR SECURING A BOAT TO A BOAT DOCK

(71) Applicants: John Figura, Labadie, MO (US); Charles Gerber, Stuart, FL (US)

(72) Inventors: John Figura, Labadie, MO (US); Charles Gerber, Stuart, FL (US)

( * ) Notice: Subject to any disclaimer, the term of this patent is extended or adjusted under 35 U.S.C. 154(b) by 9 days.

(21) Appl. No.: 17/884,810

(22) Filed: Aug. 10, 2022

(51) Int. Cl.
*B63B 21/04* (2006.01)
*B63B 21/20* (2006.01)

(52) U.S. Cl.
CPC ..... *B63B 21/04* (2013.01); *B63B 21/20* (2013.01)

(58) Field of Classification Search
CPC ..... B63B 21/00; B63B 2021/003; B63B 2021/004; B63B 21/04; B63B 21/045; B63B 21/20
USPC ..... 114/218
See application file for complete search history.

(56) References Cited

U.S. PATENT DOCUMENTS

D494,044 S 8/2004 Steele
6,840,186 B1 1/2005 Steele
7,066,102 B1 * 6/2006 Tossavainen ..... B63B 21/00 114/230.1
7,124,699 B1 * 10/2006 Clark ..... E02B 3/20 114/218
9,193,418 B1 * 11/2015 Brelsford ..... B63B 21/00
2009/0071390 A1 * 3/2009 Brelsford ..... B63B 59/02 114/230.27
2011/0168075 A1 * 7/2011 Yemm ..... E21B 41/0007 29/700
2015/0252545 A1 * 9/2015 Moran ..... E02B 3/26 405/212
2015/0314841 A1 * 11/2015 Moran ..... E02B 3/26 114/219

* cited by examiner

*Primary Examiner* — Daniel V Venne
(74) *Attorney, Agent, or Firm* — William J. Connelly, III; Connelly Law PLLC

(57) ABSTRACT

A cleat (10) for securing a boat (B) to a dock (D) includes a brace (12) having a face (14) contoured to fit against a dock piling (P) and extend around an outer surface (ES) of the piling when in place. An end (18*a*) of an adjustable strap (16) attaches to one end (20*a*) of the brace with an opposite, free end of the strap, fitting about the other end (20*b*) of the brace. An end portion (22) of this free end, when fitted about the other end of the brace, overlaps and a fastener (24) secures these overlapping portions together to secure the brace to the piling. An anchor (26) projects from a face (28) of the brace, and an anchor rope (30) attached to the boat is secured to the anchor, once the brace is secured to the piling, to secure the boat to the dock.

7 Claims, 2 Drawing Sheets

BOAT CLEAT FOR SECURING A BOAT TO A BOAT DOCK

CROSS-REFERENCE TO RELATED APPLICATIONS

None.

STATEMENT REGARDING FEDERALLY SPONSORED RESEARCH OR DEVELOPMENT

Not Applicable.

BACKGROUND

This invention relates to a portable boat cleat usable by the owner or operator of a boat to quickly and efficiently secure the boat to a boat dock or pier by affixing the cleat to a dock piling.

When tying a boat up to a dock, the boat operator will typically take one end of a rope and wrap it about a post or piling forming part of the dock. Securing, or tying off, the boat to the dock is important in preventing the boat from drifting away from the dock and into a navigable channel or waterway where it may strike, or be struck by, other vessels resulting in damage to the vessel(s) and possibly injury to those on a vessel.

Many docks have cleats located on an edge of the dock for the operator to wrap the rope around the cleat, again to dock the boat in a safe manner. It will be understood that not all docks are similarly equipped for tying a boat up to it, and often a boat's operator will have to provide his own means of securement In this regard it is not uncommon for a boat operator, when they reach a dock, to hammer a nail to the dock and wrap an end of a rope around the nail. While this may allow the boat to be tied up to the dock, it is possible for the nail to be worked loose from the dock, freeing up the boat to float away from the dock into an unsafe position.

The present invention alleviates this problem by providing the boat operator a portable, reusable cleat that the operator can securely attach to a dock piling and then securely attach an anchoring rope to the cleat so the boat is effectively secured in place. When the boat subsequently is leaving the dock, the cleat is readily retrieved and stored on the bot for future use.

BRIEF SUMMARY OF THE INVENTION

A cleat of the present invention is for quickly and efficiently securing a boat to a boat dock. The cleat includes a brace contoured to fit against a piling of the dock and extend around the outer surface of the piling when the brace is fitted in place. The cleat further includes an adjustable strap having one end which is attached to one end of the brace with an opposite, free end, of the strap fitting about the other end of the brace. An end portion of this free end, when fitted about the other end of the brace, overlaps with the overlapping portions being fastened together to secure the brace to the piling. An anchor projects from a back face of the brace. An anchor rope attached to the boat is secured to the anchor portion of the brace, once the brace is secured to the piling, to secure the boat to the dock.

Importantly, the cleat is a portable cleat that is readily unattached and removed from the piling to allow the boat to undock from one location, with the cleat then being usable to secure the boat to a dock at its next docking location.

The anchor is lightweight, portable, and conveniently stored on the boat.

More than one cleat can be used, if necessary or warranted, to secure the boat to a dock.

Other objects and features will be in part apparent and in part pointed out hereinafter.

BRIEF DESCRIPTION OF THE DRAWINGS

Corresponding reference characters represent corresponding parts throughout the several views of the drawings.

DETAILED DESCRIPTION

Figure 1:
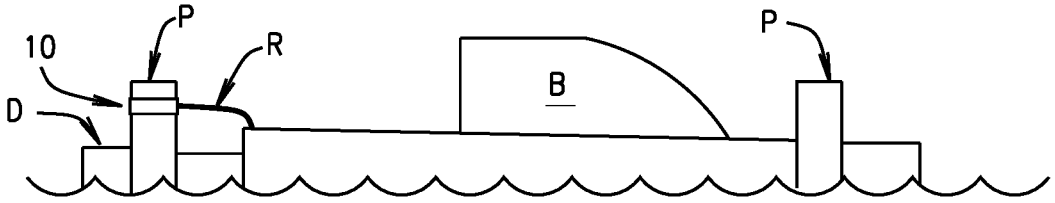
FIG. 1 is a representation of a boat being secured to a dock using a cleat of the present invention attached to a piling.

The following detailed description illustrates the claimed invention by way of example and not by way of limitation. This description will clearly enable one skilled in the art to make and use the claimed invention, and describes several embodiments, adaptations, variations, alternatives and uses of the claimed invention, including what I presently believe is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

Referring to the drawings and as shown in FIG. 1, a boat B is to be secured to a pier or dock D so that, when properly secured to the dock, boat B will not inadvertently float away from the dock and into a potentially hazardous situation. For this purpose, the present invention includes a cleat, generally indicated 10, removably attachable to a piling or pier P of the dock to quickly and efficiently secure the boat to the dock with an appropriate rope R.

Figure 2A:
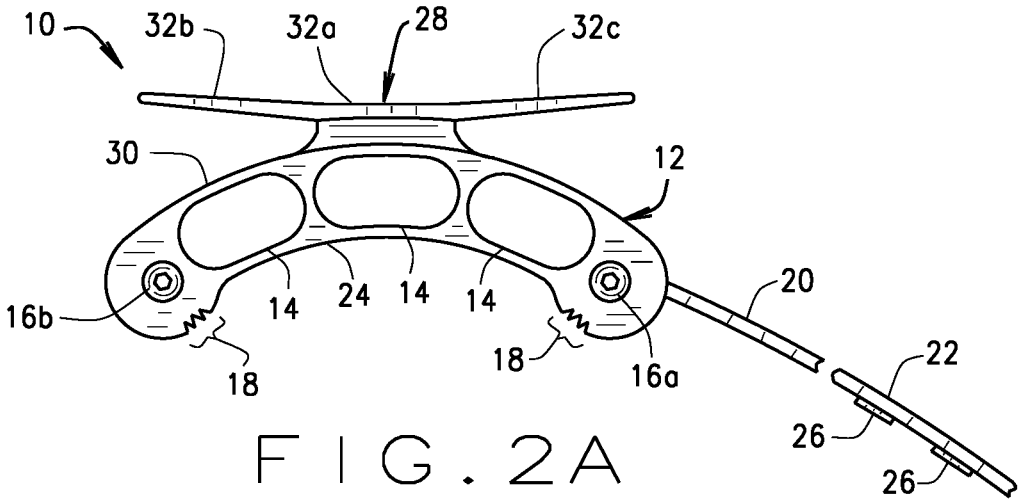
FIGS. 2A-2C are respectively top plan and front and rear elevational views of the cleat.
Figure 2B:
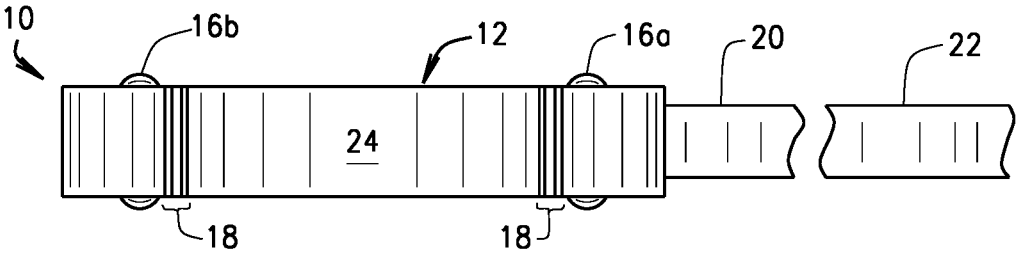
Figure 2C:
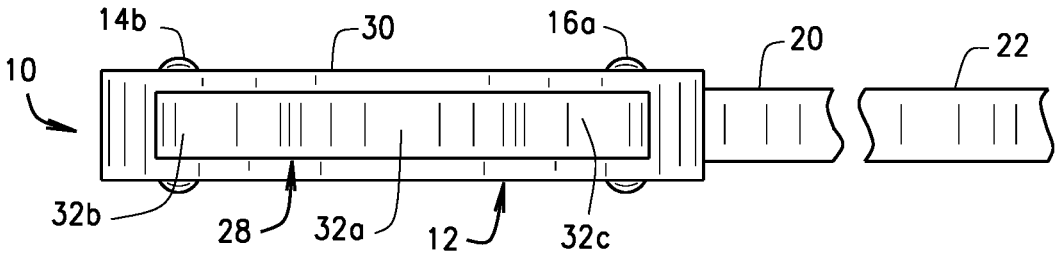
Figure 3:
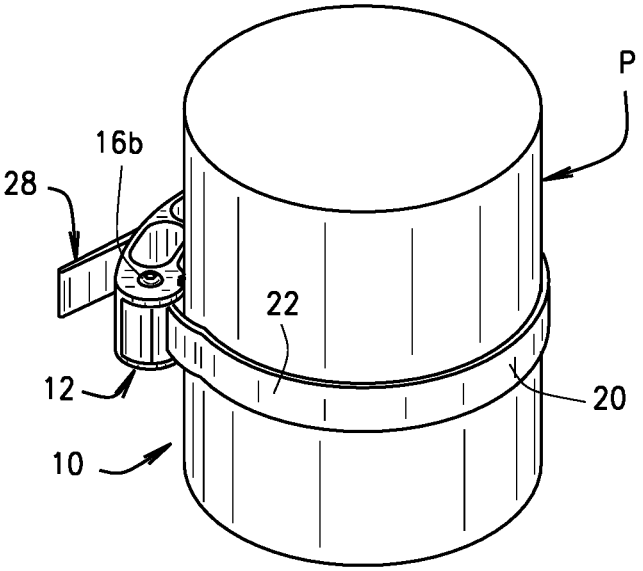
FIG. 3 illustrates another view of the boat cleat.
Figure 4:
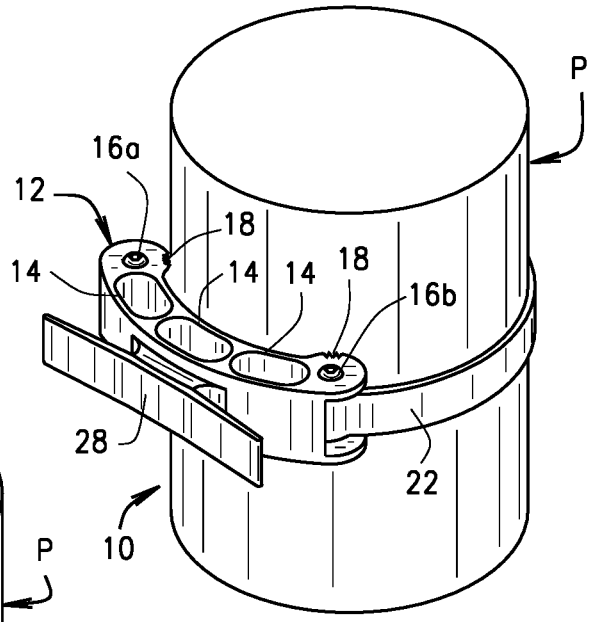
FIG. 4 illustrates the overlapping of a free end of a strap of the cleat around one end of a brace portion of the cleat to fasten the cleat to the piling.
Figure 5:
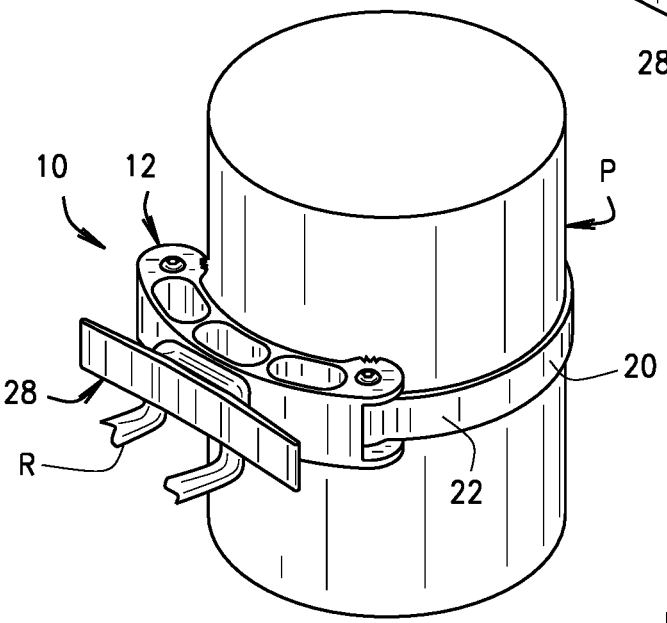
FIG. 5 illustrates the cleat installed about the piling.

As shown in FIGS. 2A-2C, cleat 10 first includes a brace 12 contoured to fit against an outer, rounded, surface of a piling as shown in FIGS. 4-5. As shown in FIGS. 4-5, brace 12 extends only partially around the outer surface of the piling when the brace is fitted in place. The brace includes a plurality of spaced, curved slots 14 formed at intervals along the length of brace 12 and extending completely through the body of the brace from its top to its bottom. Three such slots are shown the drawings, although there could be more or fewer slots. Presence of the slots serve to reduce the overall weight of cleat 10. Brace 12 is of a one-piece molded plastic or lightweight metal construction.

Next, brace 12 has a spool 16*a*, 16*b* respectively installed at each end of the brace. Also, each end of the brace is rounded with the portion of the ends which abut against the outer surface of the piling each have a series of vertically extending teeth 18 for biting into the piling, when cleat 10 is affixed to the piling, to prevent the cleat from rotating about the piling and keeping it in place.

Cleat 10 further includes an adjustable strap 20 one end of which attaches to spool 16*a* on the one end of brace 12 with an opposite, free, end 22 of the strap being wrapped about spool 16*b* at the other end of the brace. As shown in the drawings, when an inner face 24 of brace 12 is abutted against the outer surface of piling P, strap 20 is fitted around the post. The strap is sufficiently long that after wrapping around the outside of the post, there is still sufficient length of the strap to be inserted into the other end of the brace, wrapped about spool 16*b* and drawn back out. Pulling on the extending free end of the strap allows brace 12 to be tightened against the post to firmly connect cleat 10 to the post.

As shown in FIG. 2A, velcro-like pads 26 are affixed to free end 22 of strap 20. After tightening the brace against the post, appropriate pads 26 are pushed together to lock the overlapping sections of end portion 22, fastening these portions together and securing cleat 10 in place.

An anchor plate 28, integrally formed with brace 12 extends outwardly from the now outer face 30 of the brace. The anchor plate has a relatively straight section 32*a* extending across the outer portion of brace 12. The anchor plate then flares outwardly at each end of section 32*a*, as indicated 32*b* and 32*c* in the drawings. This construction allows the boat operator to conveniently wrap loops of a boat anchor rope R to secure boat B to cleat 10 and tie the boat to the dock.

When the boat is to move away from the dock, the end of anchor R is untied from cleat 10 and stored on board boat B. The overlapping sections of free end 22 of strap 20 are unattached from each other allowing the cleat to be removed from piling P, brought back on board the boat and stored away. The boat can then be manually pushed away from dock D or moved away from it under engine power.

It will be understood by those skilled in the art, that more than one cleat 10 may be used to moor a boat to a dock. Also, free end 22 of strap 20, besides having the pads 24 for fastening the overlapping portions of the end together may alternately use other fastening means such as snaps, for example.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

The invention claimed is:

1. A cleat for quickly and efficiently securing a boat to a boat dock comprising:

a brace contoured to fit against a piling of the dock and extend partially around an outer surface of the piling when the brace is fitted in place, wherein a spool is affixed to the brace at each end of the brace, with one end of a strap being fastened to the spool and the end of the strap being extendable about another spool for an end portion of a free end of the strap to overlap;

an adjustable strap one end of which attaches to one end of the brace with an opposite, free, end of the strap being fitted about an other end of the brace for the end portion of the free end of the strap, when fitted about said other end of the brace, to overlap;

overlapping portions of the free end of the strap secured together to secure the brace to the piling; and, an anchor projecting from an outer face of the brace and to which an anchor rope attached to the boat is secured, once the brace is secured to the piling, to secure the boat to the dock.

2. The cleat of claim 1 which is a portable brace carried on the boat for use when the boat is to be secured to a dock.

3. The cleat of claim 1, wherein the overlapping portions remain fastened together until unfastened by a user of the boat cleat.

4. The cleat of claim 3, wherein Velcro® pads are affixed to abutting portions of the free end of the strap when said portions are overlapped.

5. The cleat of claim 1 wherein the anchor is a generally t-shaped extending outwardly from a back face of the brace.

6. The cleat of claim 5 which the brace and anchor are of a one-piece construction.

7. The cleat of claim 5 in which a leg of the anchor extends generally perpendicular to the back face of the brace and an arm of the anchor extends generally perpendicular to the leg and parallel to the back face of the brace, said arm being spaced apart from the back face of the brace a distance sufficient for the anchor rope to wound about the leg multiple times.

* * * * *